United States Patent [19]

Klatt et al.

[11] Patent Number: 5,075,524

[45] Date of Patent: Dec. 24, 1991

[54] ELECTRIC PUSHBUTTON SWITCH

[75] Inventors: Dieter Klatt, Wülfrath; Sami Karacora, Wuppertal, both of Fed. Rep. of Germany

[73] Assignee: Stocko Metallwarenfabriken Henkels und Sohn GmbH & Co., Wuppertal, Fed. Rep. of Germany

[21] Appl. No.: 575,336

[22] Filed: Aug. 30, 1990

[30] Foreign Application Priority Data

Aug. 30, 1989 [DE] Fed. Rep. of Germany ..... 3928650

[51] Int. Cl.[5] ..... H01H 5/00

[52] U.S. Cl. ..... 200/446; 200/461; 200/517; 200/521; 200/407

[58] Field of Search ..... 200/459, 407, 341, 521, 200/517, 516, 308, 402, 452, 454, 456, 465, 460, 461, 467, 446

[56] References Cited

U.S. PATENT DOCUMENTS

| | | | |
|---|---|---|---|
| 2,700,079 | 1/1955 | Haydon | 200/460 |
| 3,800,104 | 3/1974 | Lien et al. | 200/461 X |
| 3,909,564 | 9/1975 | Scheingold et al. | 200/517 X |
| 4,385,218 | 5/1983 | Nishida | 200/406 |
| 4,484,042 | 11/1984 | Matsui | 200/521 X |
| 4,642,433 | 2/1987 | Murata | 200/521 X |
| 4,800,245 | 1/1989 | Murmann et al. | 200/517 X |

FOREIGN PATENT DOCUMENTS

| | | | |
|---|---|---|---|
| 912597 | 7/1949 | Fed. Rep. of Germany . | |
| 3530050 | 2/1987 | Fed. Rep. of Germany . | |
| 2175451 | 11/1986 | United Kingdom | 200/517 |
| 2178237 | 2/1987 | United Kingdom | 200/517 |

*Primary Examiner*—Henry J. Recla
*Assistant Examiner*—Glenn T. Barrett
*Attorney, Agent, or Firm*—Robert W. Becker & Associates

[57] ABSTRACT

A manually actuatable electric pushbutton switch that automatically returns to the starting position after actuation, especially such a switch for the keyboard of an electronic device, for example a typewriter, is provided. The switch has a plastic housing in which is disposed a plate spring that is in engagement with an actuating button. The plate spring has a region that during shifting of the actuating button and flexing of the plate spring abruptly jumps to a different position when the electrical contact position is achieved, so that the triggering function is indicated both physically as well as audibly to the user. The region of the plate spring that abruptly reverses is preferably formed by slots, between which the abruptly reversing plate spring strip is defined.

8 Claims, 2 Drawing Sheets

ELECTRIC PUSHBUTTON SWITCH

BACKGROUND OF THE INVENTION

The present invention relates to a manually actuatable electric pushbutton switch that automatically returns to the starting position after actuation, especially such a switch for the keyboard of an electronic device. The switch has a plastic housing in which is disposed a plate spring and on which is displaceably disposed an actuating button that cooperates with the plate spring, whereby the actuating button, during actuation, flexes a first region of the plate spring to establish electrical contact.

DE-OS 35 30 050 discloses a key module for foil keys. Disposed in a plastic housing is a plate spring that is bent at an obtuse angle in such a way that one leg extends essentially parallel to the base of the plastic housing, while the other leg projects freely into the interior of the housing. The plate spring is fixed within the housing by a right-angled projection of that leg that extends parallel to the base of the plastic housing, with this projection being adjustably held in place in a receiving slot of the housing. The edge region between the two legs of the plate spring defines the electrical contact position. For this purpose, displaceably disposed in the plastic housing is an actuating button that can be displaced against the force of a helical spring and that is in engagement with the upper, free end of the angled-off leg. When this actuating button is pressed downwardly, the edge region between the two legs is correspondingly moved downward in such a way that two superimposed switching foils are brought into contact with one another. After the actuating button is released, the switch returns to its starting position.

The drawback of this heretofore known key module is the uniform shape and orientation of the plate spring that triggers the electrical contact, since the user never knows exactly whether or not the key was correctly pressed and if the control function has been triggered.

DE-PS 912 597 discloses a switching key. Disposed on a base plate is a spring plate that comprises an essentially rectangular strip of resilient material. This spring plate has two elongated slots. In order to effectively shorten the length of the spring plate and to arch the central portion of the spring plate between the slots, the spring plate is arched on both sides of the slots. The front end of the spring plate, which is disposed on the base plate in this manner, thereby forms the contact location in cooperation with a second contact portion that is secured to the base plate. To actuate the switching key, an actuating element is associated with the spring plate. As this actuating element is being pressed down, the peak of the spring plate arch that is formed by the slots shifts in the direction of the free end of this spring plate in a movement that resembles t he propagation of waves. At a specific position of the actuating element, the spring plate then trips over and hence establishes the contact with the second contact portion of the base plate. Also with this heretofore known arrangement the user never knows for sure whether the switch has been correctly actuated and if the control function has been triggered.

It is an object of the present invention to improve an electric pushbutton switch of the aforementioned general type in such a way that the control reliability is improved.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
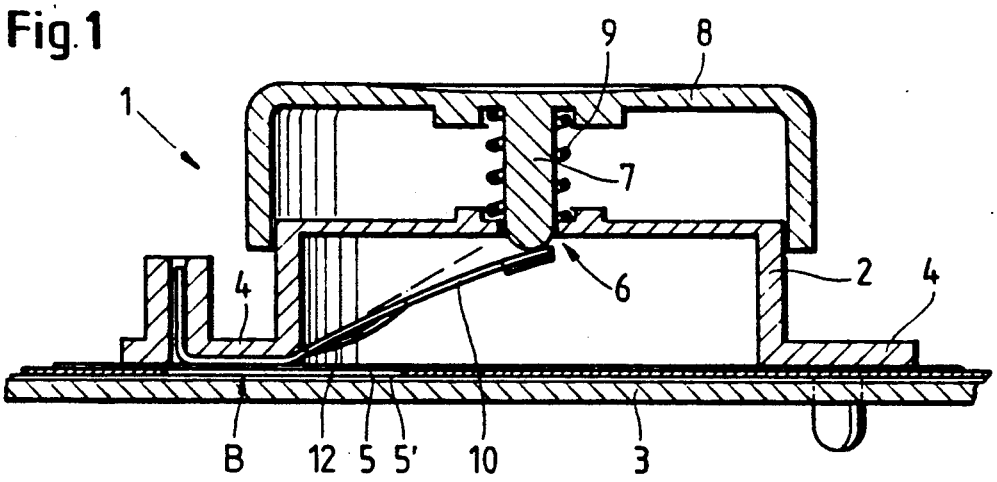
FIG. 1 is a cross-sectional view through one exemplary embodiment of the inventive electric pushbutton switch in the starting position prior to actuation.

The electric pushbutton switch of the present invention is characterized primarily in that the plate spring has a second region that during actuation of the switch and the flexing of the plate spring, abruptly jumps to a different position when the electrical contact is achieved, and thereby acts as a physical and audible pressure point.

Due to the abrupt jumping or reversal of the plate spring when the electrical contact position is achieved, not only a physical but also an audible pressure point is provided, thereby greatly increasing the control reliability. This is true because as soon as the plate spring deflects under load and achieves the prescribed operating point, a portion of the plate spring abruptly snaps, which not only generates an audible "click", but can also be felt or noticed in the finger of the user. Thus, the triggering function of the pushbutton switch is communicated to the operator via a pressure point in two ways.

Pursuant to one preferred specific embodiment of the present invention, the plate spring has two slots that essentially extend in the longitudinal direction, with the region of the plate spring that abruptly reverses into a different position being defined between these two slots. In the starting position, this plate spring strip, which is defined between the two slots, is curved oppositely to the curvature of the remainder of the plate spring in this region during actuation of the pushbutton, whereby when the electrical contact is achieved, the curvature of the plate spring strip abruptly reverses and then corresponds to the curvature of the remainder of the plate spring. Such a plate spring can be produced in a technically straightforward manner, and above all operates very reliably. In this connection, the operating point can be varied via an appropriate design and configuration of the plate spring, in particular with regard to the curvature and the length and width of the slots thereof.

The slots preferably extend parallel to one another.

In order to be able to produce the curvature of the plate spring strip in a technically straightforward manner, this curvature is preferably provided via a preembossment.

Pursuant to one specific embodiment of the present invention, the plate spring is bent at an obtuse angle, with one leg being secured in place in the plastic housing and extending essentially parallel to the base of the housing, while the other leg projects freely into the interior of the plastic housing and is in engagement with the actuating button, whereby the edge region between the two legs defines the electrical contact position; starting from this edge region, the slots extend in the direction of the free end of the freely projecting leg. In this way, despite a straightforward construction, a reliably operating electric pushbutton switch !s provided that very reliably triggers the desired operation. The transition region between the two legs of the plate spring is arched outwardly upon actuation of the actuating button in such a way that therewith it is possible, for example, to close the contact between two leads of a circuit.

Pursuant to a further specific embodiment, the projecting leg is angled off in an S-shaped manner in the region of the free end thereof in front of the plate spring strip. In this connection, as viewed from the edge region of the two legs of the plate spring, the first bend is in the same direction as the bend between the two legs, while the second bend is in the opposite direction. This provides an optimum bending condition of the plate spring.

Pursuant to another embodiment, the plate spring is preferably a stamped sheet metal part. In this way, the plate spring can be produced in a technically straightforward manner, with the appropriate bending processes being effected after the stamping.

Thus, it should be noted that the present invention also provides a plate spring for an electric pushbutton switch.

Further specific features of the present invention will be described in detail subsequently.

DESCRIPTION OF PREFERRED EMBODIMENTS

Referring now to the drawings in detail, FIG. 1 illustrates the starting position of one exemplary embodiment of the inventive electric pushbutton switch 1, for example for the keyboard of a typewriter. The plastic housing 2 of the electric pushbutton switch 1 is secured to a support plate 3, for example by being riveted thereto. Two leads 5, 5' of a switching circuit extend between the base 4 of the plastic housing 2 and the support plate 3. This switching circuit is intended to be closed, by actuating the electric pushbutton switch 1, for initiating the appropriate function. For this purpose, in the region B the two electric leads 5, 5' are exposed in such a way that upon actuation of an appropriate mechanism, these leads contact one another and can hence close the circuit. Beyond this region B, the electric leads 5, 5' are insulated relative to one another.

On the upper side, the plastic housing 2 is provided with an opening 6 into which extends the pin 7 of an actuating button 8. Braced between the upper side of the plastic housing 2 and the underside of the actuating button 8 is a spring 9 that helically surrounds the pin 7; as a result, this spring presses the actuating button 8 into the upper starting position Disposed within the plastic housing 2 is a plate spring 10 that is shown in detail in the enlarged views of FIGS. 4 and 5. The plate spring 10 is bent at an obtuse angle to form two legs 10', 10''. The short leg 10' rests against the underside of the base 4 of the plastic housing 2 and in so doing is held firmly in place between this base 4 and the upper side of the support plate 3, or more specifically the leads 5, 5' that are disposed thereon. To provide an additional fixation, the free end of this short leg 10' is bent upwardly and is received in a slot of the plastic housing 2 in order to fix the position of the plate spring 10.

Figure 4:
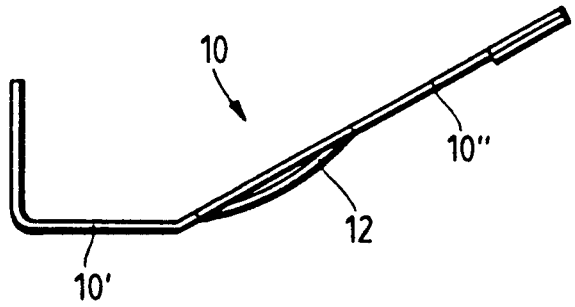
FIG. 4 is a side view of a plate spring used in the electric pushbutton switch of FIGS. 1–3.

The long leg 10'' extends at an angle upwardly into the interior of the plastic housing 2, with the bottom end of the pin 7 resting upon the upper side of the free end of this long leg 10'', as can be seen in FIG. 1. The long leg 10'' of the plate spring 10 has two slots 11 that extend in the longitudinal direction of the plate spring 10 as can be seen in particular in the plan view of FIG. 5. A plate spring strip 12 is formed between the two slots 11, which extend parallel to one another. In the starting position of the plate spring 10, this plate spring strip 12 is curved outwardly by a preembossment, as can be seen in FIGS. 1 and 4. The center point of the curvature of this plate spring strip 12, relative to the center point of curvature of the rest of the leg 10'' of the plate spring when the actuating button 8 is pressed down, is disposed on the other side of the long leg 10'' of the plate spring 10, so that in general the long leg 10'' of the plate spring 10 is curved convexly, whereas the plate spring 12 is curved concavely.

Figure 2:
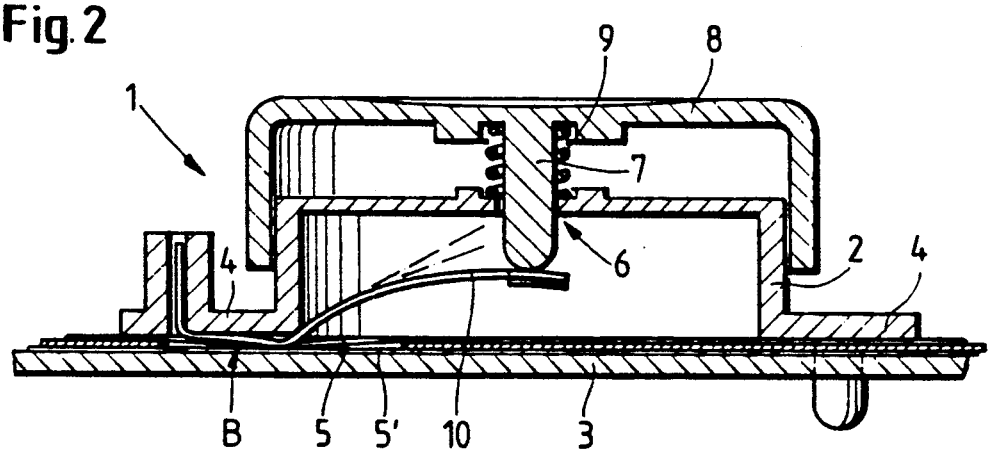
FIG. 2 shows the electric pushbutton switch of FIG. 1, yet after the actuating button has been pushed down somewhat and the plate spring has abruptly reversed.

FIG. 2 illustrates the situation where the actuating button 8 has been pressed down somewhat In this connection, the short leg 10' of the plate spring 10 has been bent downwardly, with the slot of the plastic housing 2 serving as a pivot point, so that the edge region between the two legs 10', 10'' of the plate spring 10 is moved downwardly in such a way that the two leads 5, 5' come to rest against one another and hence initiate the appropriate switching process. In this electrical contact position, the radius of curvature in the long leg 10'' of the plate spring 10 is reduced to such an extent, and hence the curvature becomes so great, that the curvature of the plate spring strip 12 that is defined between the two slots 11 abruptly reverses such that the center point of the curvature of the plate spring strip 12 is disposed on the same side of the plate spring 10 as the overall center point of curvature of the remainder of the long leg 10''. This abrupt reversal of the plato spring strip 12 is noticed by the user not only as a physical sensation in the finger, but is also heard as a "click", so that the user can not only audibly but also physically perceive that the electrical contact for triggering the control functions has been effected.

Figure 3:
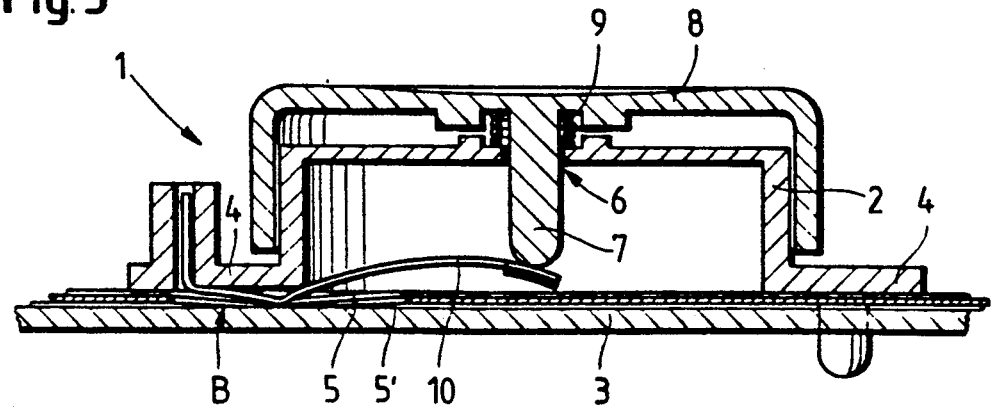
FIG. 3 shows the pushbutton switch of FIGS. 1 and 2 after the actuating button has been pushed completely down.

FIG. 3 finally illustrates the situation after the actuating button 8 has been pressed completely downwardly.

As soon as the actuating button 8 is released, it automatically returns to its starting position. This is achieved on the one hand by means of the spring 9, and on the other hand by the plate spring 10, which presses the actuating button 8 upwardly via the pin 7. In an intermediate position (between the positions illustrated in FIGS. 1 and 2) the curvature of the long leg 10'' of the plate spring 10 is reduced to such an extent that the plate spring strip 12 again abruptly reverses in the opposite direction, which can again be perceived both audibly as well as physically.

Figure 5:
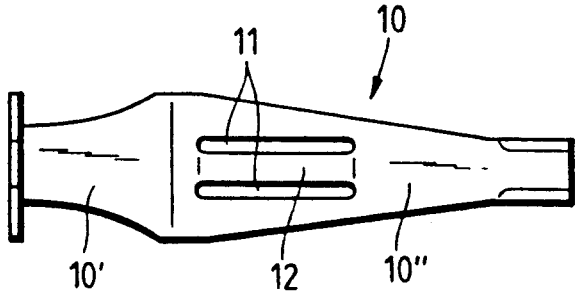
FIG. 5 is a plan view of the plate spring of FIG. 4.
Figure 6:
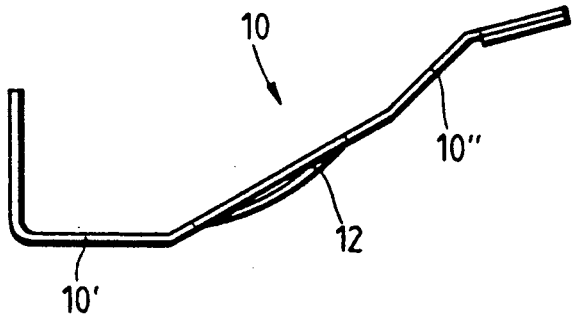
FIG. 6 is a side view of a somewhat modified plate spring that has an additional S-shaped bend.
Figure 7:
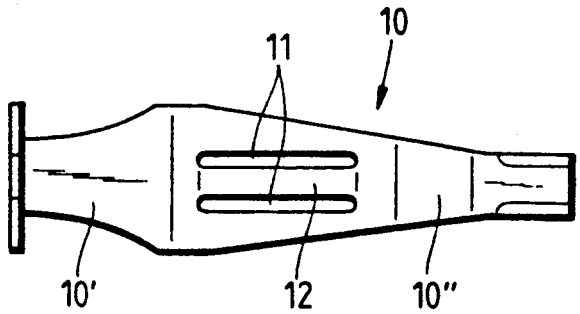
FIG. 7 is a plan view of the plate spring of FIG. 6.

FIGS. 6 and 7 illustrate a modified embodiment of a plate spring 10. The difference from the embodiment of FIGS. 4 and 5 is that the long leg 10'' of the plate spring 10 does not extend linearly. Rather, in this modified embodiment, in the region of its free end, the long leg 10'' is bent in an S-shaped manner, as can be seen particularly clearly in FIG. 6. This embodiment of the plate spring 10 operates in a manner similar to that described in connection with the embodiment of FIGS. 4 and 5 (as well as FIG. 1–3).

The present invention is, of course, in no way restricted to the specific disclosure of the specification and drawings, but also encompasses any modifications within the scope of the appended claims.

What we claim is:

1. In a manually actuatable electric pushbutton switch that automatically returns to a starting position after actuation, with said switch having a plastic housing in which is disposed a plate spring and on which is displaceably disposed an actuating button that cooperates with said plate spring, whereby said actuating button, during actuation, flexes said plate spring to establish electrical contact and when electrical contact is established said plate spring abruptly jumps to a different position and thereby acts as a physical and audible pressure point, the improvement wherein:

said plate spring has a first and a second region that are separate from one another, whereby said first region serves to achieve electrical contact and said second region abruptly jumps to a different position when said electrical contact is achieved.

2. An electric pushbutton switch according to claim 1, in which said plate spring is provided with two slots that essentially extend in a longitudinal direction of said plate spring and between which is defined said second region of said plate spring that abruptly jumps to a different position, with said second region being in the form of a plate spring strip that in said starting position has a curvature that is opposite to the curvature of the remainder of said plate spring in this vicinity, and whereby upon achieving said electrical contact, the curvature of said plate spring strip abruptly reverses to correspond to the curvature of the remainder of said plate spring.

3. An electric pushbutton switch according to claim 2, in which said slots extend parallel to one another.

4. An electric pushbutton switch according to claim 3, in which the curvature of said plate spring strip is provided via a preembossment.

5. An electric pushbutton switch according to claim 2, in which said plate spring is bent at an obtuse angle to form two legs joined by an edge region that defines an electrical contact position, with one of said legs being held firmly in place in said plastic housing and extending essentially parallel to a base of said housing, and with the other of said legs projecting freely into an interior of said housing and being in contact with said actuating button; said slots of said plate spring proceed from the vicinity of said edge region between said two legs in a direction toward a free end of said other, freely projecting leg.

6. An electric pushbutton switch according to claim 5, in which said other, freely projecting leg, outwardly of said plate spring strip, is bent twice in opposite directions.

7. An electric pushbutton switch according to claim 2, in which said plate spring is a stamped sheet metal part.

8. In a plate spring for a manually actuatable electric pushbutton switch that automatically returns to a starting position after actuation, with said switch having a plastic housing in which is disposed said plate spring and on which is displaceably disposed an actuating button that cooperates with said plate spring, whereby said actuating button, during actuation, flexes a first region of said plate spring to establish electrical contact, the improvement wherein:

said plate spring has a second region that during actuation of said switch and said flexing of said plate spring, abruptly jumps to a different position when said electrical contact is achieved, and thereby acts as a physical and audible pressure point.

* * * * *